US008487219B2

(12) United States Patent
Pedemonte et al.

(10) Patent No.: US 8,487,219 B2
(45) Date of Patent: Jul. 16, 2013

(54) INK DRYING APPARATUS, METHODS TO CONTROL INK DRYING APPARATUS, AND POWER CONTROL APPARATUS TO CONTROL INK DRYING ELEMENTS

(75) Inventors: Xavier Soler Pedemonte, Barcelona (ES); José Maria Montserrat Caldero, Barcelona (ES); Francisco Javier Pérez Gellida, Barcelona (ES); David Toussaint, Barcelona (ES); Gianni Cessel, Rubi (ES); Andrew Maxwell Frost, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 338 days.

(21) Appl. No.: 12/790,982

(22) Filed: May 31, 2010

(65) Prior Publication Data

US 2011/0290777 A1 Dec. 1, 2011

(51) Int. Cl.
*H05B 3/00* (2006.01)

(52) U.S. Cl.
USPC ..... 219/216

(58) Field of Classification Search
USPC ..... 219/216, 512, 121.67, 491; 707/703
See application file for complete search history.

(56) References Cited

U.S. PATENT DOCUMENTS

| | | | | |
|---|---|---|---|---|
| 5,088,389 | A | 2/1992 | Labadia del Fresno | |
| 5,438,914 | A | 8/1995 | Hohn et al. | |
| 6,491,361 | B1 * | 12/2002 | Spann | 347/2 |
| 6,707,264 | B2 | 3/2004 | Lin et al. | |
| 6,877,247 | B1 | 4/2005 | DeMoore | |
| 7,137,694 | B2 | 11/2006 | Ferran et al. | |
| 7,212,735 | B2 | 5/2007 | Konishi | |
| 7,267,597 | B2 | 9/2007 | Konishi et al. | |
| 7,312,420 | B2 * | 12/2007 | Smith | 219/216 |
| 7,551,846 | B2 | 6/2009 | Konishi et al. | |
| 7,723,645 | B2 * | 5/2010 | Smith | 219/216 |
| 2007/0062923 | A1 * | 3/2007 | Smith | 219/216 |

* cited by examiner

*Primary Examiner* — Nathan Ha

(57) ABSTRACT

Ink drying apparatus and method for controlling ink drying apparatus are described herein. An example ink drying apparatus includes first and second heating elements positioned adjacent a drying area in a printer, and a controller to determine a temperature of the heating area and to selectively operate, based on the temperature determination, the first heating element in a burst mode and the second heating element in an on/off mode.

15 Claims, 6 Drawing Sheets

INK DRYING APPARATUS, METHODS TO CONTROL INK DRYING APPARATUS, AND POWER CONTROL APPARATUS TO CONTROL INK DRYING ELEMENTS

BACKGROUND

Flicker is an electrical effect that can occur in power distribution networks such as commercial power distribution utility networks. Flicker occurs when relatively large electronic loads are connected and disconnected to a power distribution network (e.g., an alternating current (AC) power distribution network) within a range of frequencies that are perceptible to humans. Devices such as light bulbs are sensitive to drops in voltage and/or current and have noticeable changes in performance in response to flicker. Such changes, when occurring within a range of frequencies and intensities, can be annoying to people within view of the light bulb. Thus, some governmental agencies have issued or adopted regulations for equipment that is connected to public power distribution networks and draws power greater than a defined threshold.

DETAILED DESCRIPTION

Figure 1:
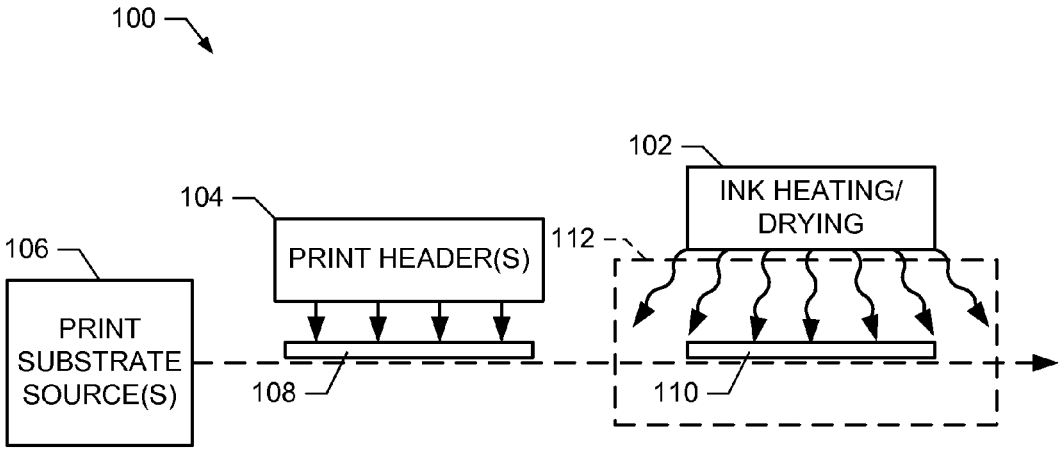
FIG. 1 is a block diagram of an example printer constructed in accordance with the teachings of this disclosure.

Several examples are described throughout this specification. The figures are not necessarily to scale and certain features and certain views of the figures may be shown exaggerated in scale or in schematic for clarity and/or conciseness. Although the following discloses example methods, apparatus, and articles of manufacture, it should be noted that such methods, apparatus, and articles of manufacture are merely illustrative and should not be considered as limiting the scope of this disclosure.

Some types of printer ink, such as latex-based inks, have improved finish quality when dried by heating the ink after applying the ink to a print substrate (e.g., printer paper). The example ink drying apparatus and methods to control ink drying apparatus described herein may be used to heat and dry inks applied to a print substrate in a printer while complying with regulations on electrical equipment that are or may be implemented by government agencies in certain locations and/or countries. Some example regulations of note include a flicker requirement (e.g., International Electrotechnical Commission (IEC) 61000-3-3), a harmonics requirement (e.g., the IEC 61000-3-2 or IEC 61000-3-4), and/or an electromagnetic interference (EMI) requirement (e.g., IEC 61000-3-6 or IEC 61000-3-7). Some example heating apparatus described herein comply with each of the example flicker requirement, the harmonics requirement, and the EMI requirement. Some example heating apparatus described below include two or more heating elements positioned adjacent a heating area and a controller to control the heating elements according to a temperature of the heating area. In some examples, the controller selectively causes electrical power to be applied to a first one of the heating elements using a burst mode and to a second one of the heating elements using an on/off mode.

As noted, in some examples the controller controls the application of electrical power to one or more of the heating elements by causing power electronics to apply alternating current (AC current) to the heating element(s) in a burst mode. In burst mode, the controller applies the AC current to a heating element for a portion of a heating period (e.g., a duty cycle) that includes a substantially whole multiple of an AC current period (e.g., 1/50 Hertz (Hz) or 20 milliseconds (ms), 1/60 Hz or 16.67 ms). In some examples, the portion of the heating period ranges from 0% to 100% in whole and/or half AC-period increments. In some examples, the controller couples and/or decouples the heating element(s) to an AC current source when the AC current is substantially at a neutral (e.g., ground, zero) voltage, thereby reducing harmonics in the AC current source. The heating period may be set and/or adjusted based on a desired ink drying temperature, the upper power output of the heating element (e.g., a duty cycle of 100%), and a number and/or power output of other heating elements that are powered.

As noted, in some examples the controller controls the application of electrical power to one or more of the heating elements by applying AC current to the heating element(s) in an on/off mode. In contrast to heating elements controlled in burst mode, heating element(s) that are controlled in on/off mode remain in an on state or an off state for either substantially zero or substantially 100% of a heating period that is longer than the AC current period. In some examples, a heating element is maintained in either an on mode or an off mode when the desired ink drying temperature is substantially constant.

Turning to the figures, FIG. 1 is a block diagram of an example printer 100 that includes an ink drying apparatus 102 and one or more printhead(s) 104. The printer 100 further includes one or more print substrate source(s) 106 (e.g., sheet feeders, roll feeders) to feed print substrate(s) 108 and 110 (e.g., printer paper and/or other print media) to the printhead(s) 104 for application of ink.

The print substrates 108 and 110 are directed from the print substrate source(s) to the printhead(s) 104, which apply one or more layer(s) of ink to the print substrate 108. After having ink applied, the print substrate 110 moves to an ink drying area 112 adjacent the ink drying apparatus 102. The example ink drying apparatus 102 applies heat to the ink on the print substrate 110 (for example, at a substantially constant temperature) to dry the ink. After the ink dries, the print substrate 110 is directed out of the ink drying area 112 and the print substrate 108 may be directed into the ink drying area 112.

Figure 2:
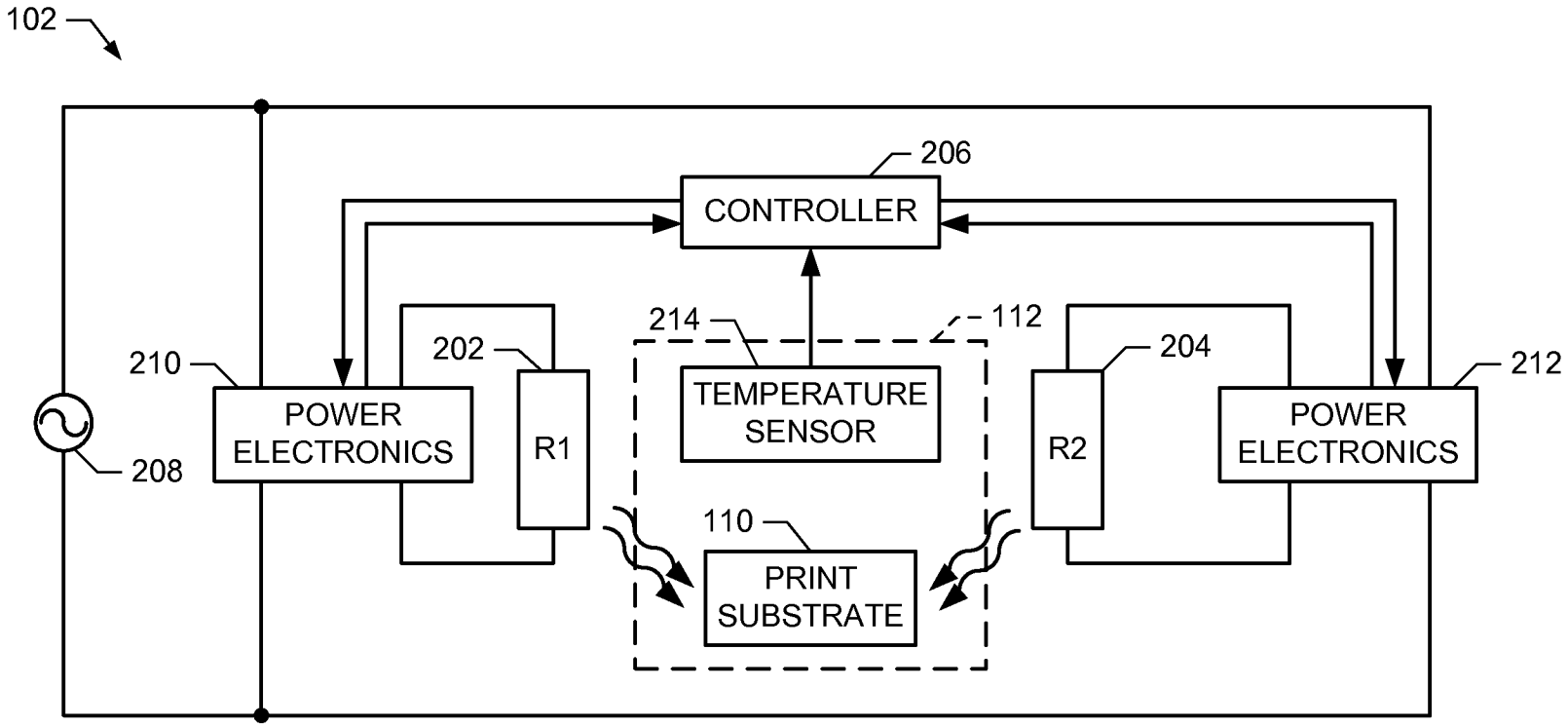
FIG. 2 is a more detailed block diagram of the example ink drying apparatus illustrated in FIG. 1.

FIG. 2 is a more detailed schematic diagram of the example ink drying apparatus 102 of FIG. 1. The example ink drying apparatus 102 includes two heating elements 202 and 204 and a controller 206. The heating elements 202 and 204 are coupled to an AC power source 208 (e.g., a commercial and/or public electrical power grid) via respective power electronics 210 and 212. An example implementation for the power electronics 210 and 212 is described in more detail below.

The heating elements 202 and 204 are positioned adjacent the ink drying area 112 of FIG. 1, through which the print substrate 110 is directed. When the print substrate 110 is in the ink drying area 112, the heating elements 202 and 204 apply heat in the form of infrared radiation to ink on the print substrate 110. The example ink drying apparatus 102 further includes a temperature sensor 214 positioned within the ink drying area 112 to determine a temperature within the ink drying area 112. In the example of FIG. 2, the ink drying apparatus 102 (e.g., via the heating elements 202 and 204) maintains the ink drying area 112 at a substantially constant temperature (e.g., within ±0.5 degrees Celsius). However, the controller 206 may control the heating elements 202 and 204 to change the temperature when, for example, the printer 100 changes print jobs.

Figure 3:
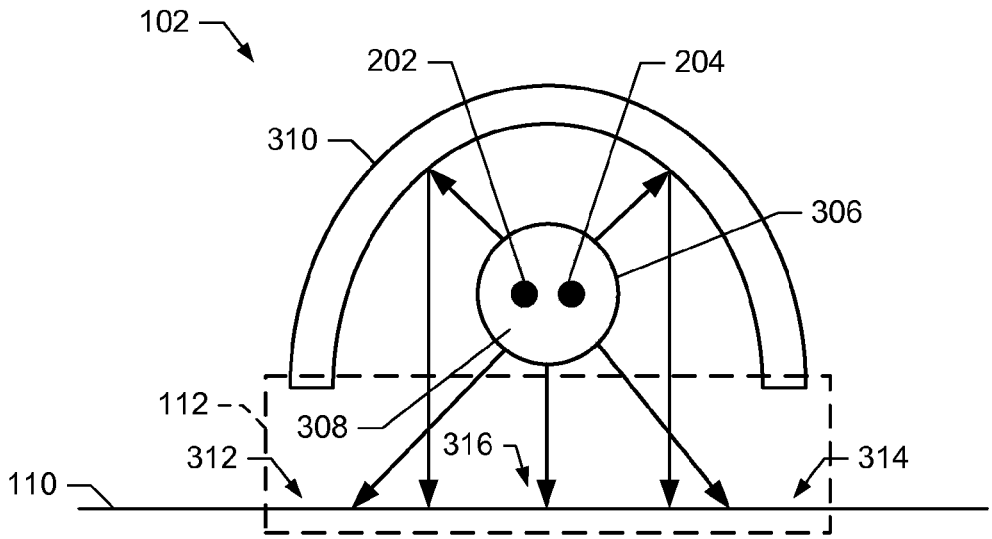
FIG. 3 is a cross-sectional view of example heating elements to implement the heating elements of FIG. 2.
Figure 4:
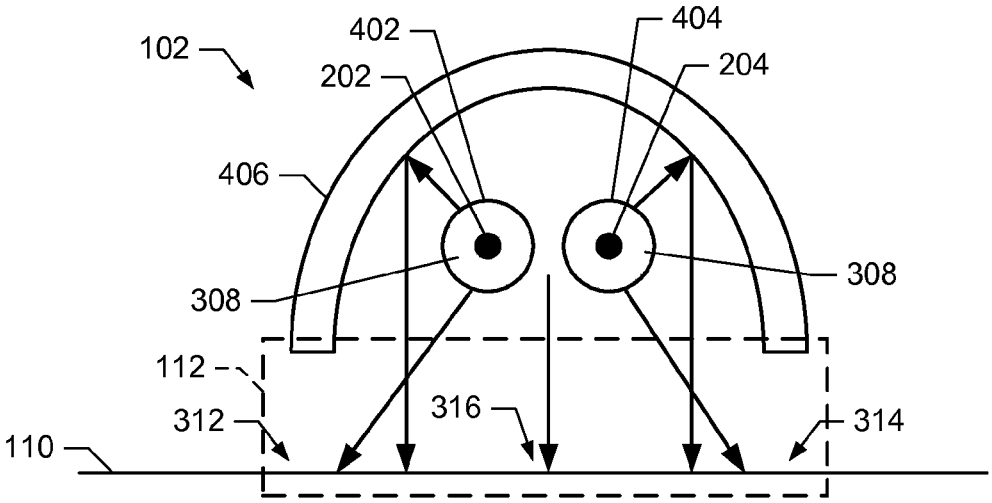
FIG. 4 is a cross-sectional view of alternative example heating elements to implement the heating elements of FIG. 2.

When the controller 206 applies AC power to the example heating elements 202 and 204, the powered heating elements 202 and 204 generate heat in the form of infrared radiation. The example heating elements 202 and 204 of FIG. 2 are diagrammatically represented by resistive elements; however, any infrared heater may be used to implement either of the heating elements 202 or 204. FIGS. 3 and 4 illustrate example ink drying apparatus 102 including heating elements 202 and 204 that may be used to implement the heating elements 202 and 204 of FIG. 2. In the example illustrated in FIG. 3, the heating elements 202 and 204 are enclosed within a protective case 306. The protective case 306 may be constructed using, for example, tempered glass to permit infrared radiation emitted from the heating elements 202 and 204 to pass through the protective case 306. In some examples, the protective case 306 is filled with a thermally insulating material 308 to stabilize the temperature in the ink drying area 112. For example, the thermally insulating material 308 may even out the emission of heat from the heating elements 202 and 204 over the course of a burst cycle, which is described in more detail below.

The example ink drying apparatus 102 illustrated in FIG. 3 further includes a reflector 310. The example reflector 310 is curved to reflect heat (e.g., infrared radiation) that is emitted in a direction away from the print substrate 110 by the heating elements 202 and 204. The reflector 310 redirects reflected heat back at the print substrate 110. Thus, a larger portion of the power dissipated by the heating elements 202 and 204 is used to heat and dry the ink on the print substrate 110, making the heating elements 202 and 204 more efficient. In the illustrated example, the reflector 310 has a curve that substantially evenly distributes the reflected radiation over the surface area of the print substrate 110 instead of concentrating the reflected radiation on a portion of the print substrate 110. In some other examples, the reflector 310 may be curved to reflect more radiation toward periphery region(s) 312 and 314 of the print substrate 110 than toward a center region 316 of the print substrate 110 to compensate for a concentration of energy directed from the heating elements 202 and 204 to the center region 316.

An alternative implementation of the example ink drying apparatus 102 of FIGS. 1 and 2 is illustrated in FIG. 4. In contrast to the example implementation shown in FIG. 3, the example implementation of FIG. 4 includes heating elements 202 and 204 having respective individual protective cases 402 and 404. The example protective cases 402 and 404 may be constructed using, for example, tempered glass similar to that of the example protective case 306 of FIG. 3. Similarly, the protective cases 402 and 404 may also be filled with the thermally insulating material 308 or a different insulating material. Alternatively, the protective cases 402 and 404 may omit the insulating material 308.

Additional heating elements may be added to the example protective cases 306, 402, or 404 in FIGS. 3 and 4. For example, additional heating elements may be added to the protective case 306 to provide additional power and/or more precise temperature control without adding an additional protective case. In other examples, one or both of the protective cases 402 or 404 include additional heating elements. In yet other examples, additional protective cases enclosing additional heating elements are added to the heating elements 202 and 204 and the protective cases 402 and 404.

The example ink drying apparatus 102 of FIG. 4 further includes a reflector 406 similar to the reflector 310 illustrated in FIG. 3. The reflector 406 reflects radiation from the heating elements 202 and 204 toward the print substrate 110. Additionally, the example reflector 406 is curved, based on the spacing of the heating elements, to substantially evenly distribute reflected radiation over the area of the print substrate 110. In some examples, the reflector 406 may be curved to reflect more radiation toward the periphery region(s) 312 and 314 of the print substrate 110 than toward the center region 316 of the print substrate 110 to compensate for a concentration of radiation directed from the heating elements 202 and 204 to the center region 316.

Figure 5:
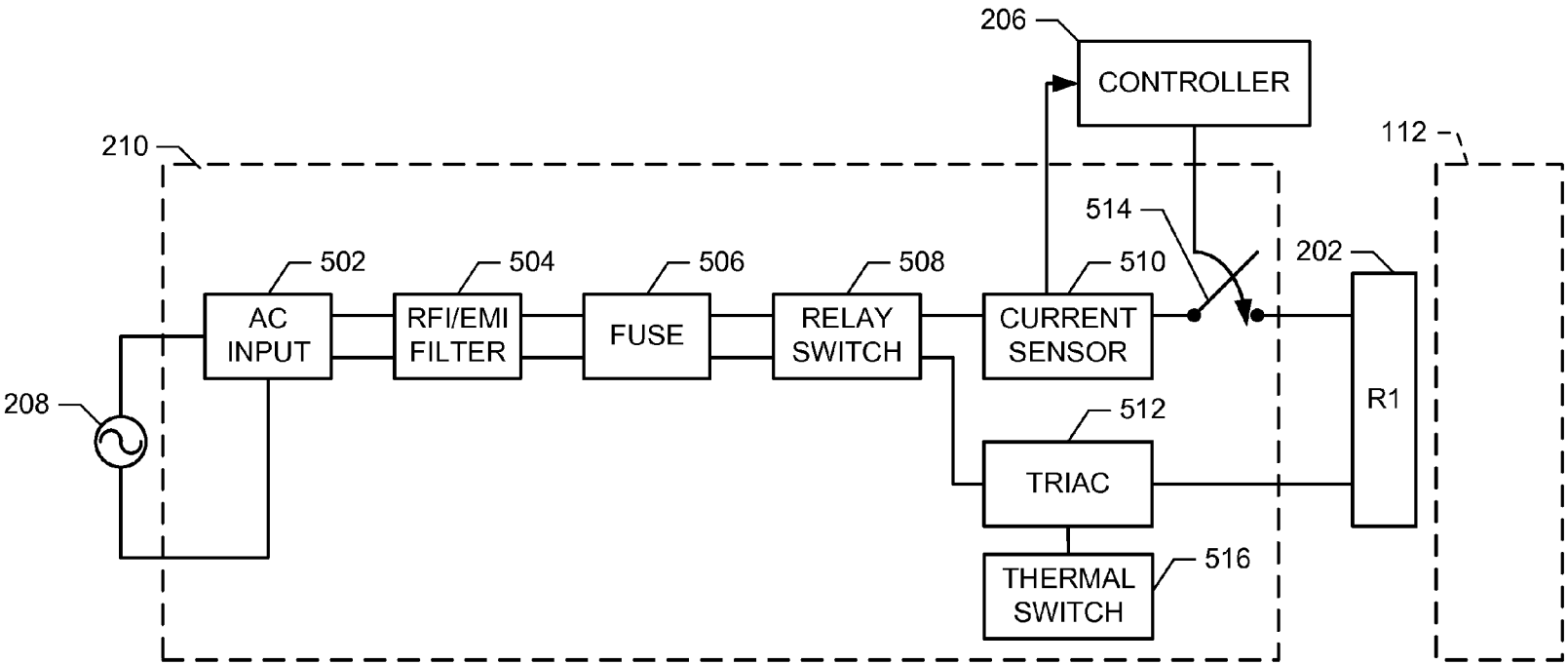
FIG. 5 is a more detailed block diagram of the example power electronics of FIG. 2.

FIG. 5 is a more detailed block diagram of example power electronics that may be used to implement the power electronics 210 and 212 of FIG. 2. For the purposes of describing FIG. 5, the following description will refer only to the power electronics 210. However, the description of the power electronics 210 in FIG. 5 is equally applicable to the power electronics 212 and/or other power electronics.

The example power electronics 210 includes an AC input 502, a radio frequency interference (RFI) and/or electromagnetic interference (EMI) filter 504, a fuse 506, a relay switch 508, a current sensor 510, a triac 512, a control switch 514, and a thermal switch 516. The AC input 502 is connected to the AC power source 208. The RFI/EMI filter 504 filters the AC current received at the AC input to remove interference from the AC current and/or to prevent the power electronics and/or other circuitry within the ink drying apparatus 102 from transmitting interference back to the AC source 208.

The fuse 506 protects the ink drying apparatus 102 from potential damage as a result of current in excess of a current limit. The relay switch 508 may be used as a safety device, similar to the fuse 506, to disconnect the AC input 502 from the remainder of the ink drying apparatus 102.

An output of the relay switch 508 is input to the current sensor 510 and with the triac 512. The output of the example current sensor 510 is used as an input to the controller 206 to determine whether a burst mode and/or an on/off mode should be used for the heating element 202 to reach a desired temperature. For example, if the current sensed by the current sensor 510 is relatively low, the controller 206 may apply a higher burst mode duty cycle to the heating element 202 than if the current is higher.

The controller 206 controls the power electronics 210 by selectively closing the control switch 514 to operate the heating element 202 in a burst mode and/or an on/off mode. The triac 512 controls the conduction of current through the heating element 202. However, the example triac 512 is controlled via the thermal switch 516, which turns off conduction through the triac 512 and, thus, through the heating element 202 (regardless of the position of the control switch 514) if, for example, the temperature in the ink drying area 112 increases above a threshold as measured by the temperature sensor 214. In some examples, the thermal switch 516 may be integrated into the temperature sensor 214 of FIG. 2. The triac 512 may additionally or alternatively be used to control the burst mode and/or the on/off mode of the heating element 202.

Returning to FIG. 2, to dry ink applied to the print substrate 110 (e.g., by the printhead(s) 104 of FIG. 1), the controller 206 determines the current temperature of the ink drying area 112 based on a signal from the temperature sensor 214. The controller 206 additionally or alternatively determines a desired temperature of the ink drying area 112 based on, for example, ink coverage of the print substrate 110, ink type, printing speed (e.g., in pages per minute), and/or other ink drying factors. In some examples, the desired temperature is set by a user of the ink drying apparatus 102 (not shown) and/or obtained from a lookup table based on inputs from, for example, a user or sensors distributed in the printing press. Based on the current temperature and/or the desired temperature, the controller 206 of the illustrated example selects a burst length for the first heating element 202 (which operates in a burst mode in accordance with a burst length) and selects an on mode or an off mode for the second heating element 204.

TABLE 1

| Control Level | | Power Level | | |
|---|---|---|---|---|
| R1 (Burst) | R2 (On/Off) | R1 | R2 | Total |
| 25% | Off | 25% | 0% | 25% |
| 50% | Off | 50% | 0% | 50% |
| 75% | Off | 75% | 0% | 75% |
| 100% | Off | 100% | 0% | 100% |
| 25% | On | 25% | 100% | 125% |
| 50% | On | 50% | 100% | 150% |
| 75% | On | 75% | 100% | 175% |
| 100% | On | 100% | 100% | 200% |

Table 1 illustrates an example list of burst modes and on/off modes that may be used by the controller 206 and the heating elements 202 and 204 to produce a desired temperature within the ink drying area 112. The percentages in Table 1 are with respect to the power dissipation or output of one of the heating elements 202 or 204. In the illustrated example, the heating elements 202 and 204 have equal maximum power dissipation. However, the heating elements 202 and 204 may have different maximum power dissipations to obtain different temperature ranges.

The example burst control levels illustrated in Table 1 may be achieved by applying AC power to the heating element 202 for the specified percentage of a predefined heating period (e.g., between 10 and –25 seconds). The burst control levels are determined by the AC frequency of the AC source 208 (e.g., about 60 Hertz (Hz) in United States systems, about 50 Hz in European Union systems, etc.) and the length of the heating period. In particular, the burst control levels are selected to provide bursts comprising full and/or half AC cycles where power may be connected and disconnected from the heating element 202 approximately when the AC current is at a zero crossing (e.g., the AC voltage is at neutral, the AC current is zero). By applying and disconnecting the burst at the AC current zero crossings, the example ink drying apparatus 102 reduces or substantially avoids causing frequency harmonics (which are also regulated in some countries) at the AC source 208.

Figure 6A:
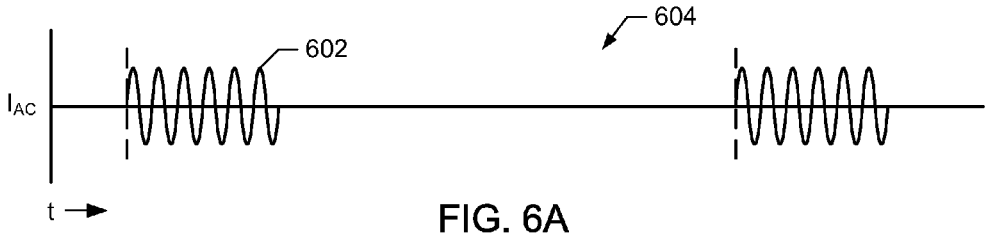
FIGS. 6A-6C illustrate example electrical voltages and/or currents applied to the heating elements of FIG. 2 controlled in a burst mode.
Figure 6B:
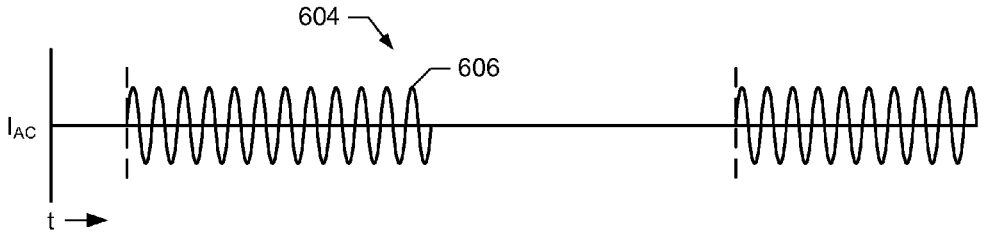
Figure 6C:
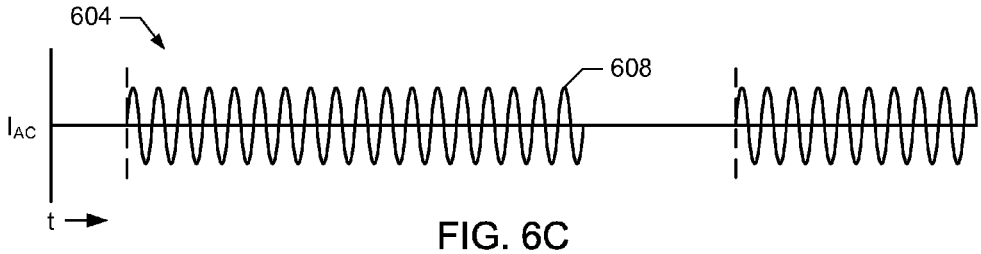
Figure 6D:
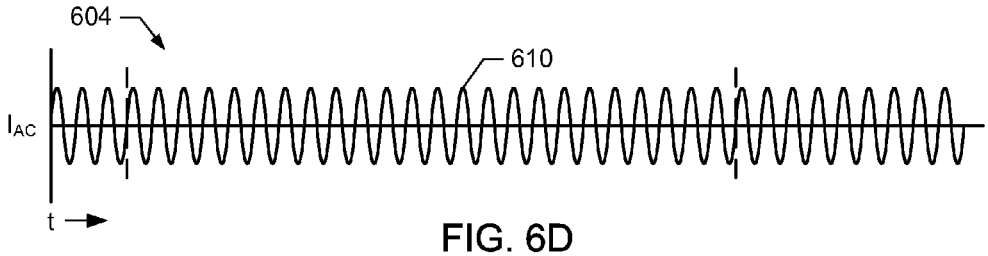
FIG. 6D illustrates example electrical voltages and/or currents applied to the heating elements of FIG. 2 controlled in an on/off mode.

The example burst control levels of Table 1 are illustrated in FIGS. 6A, 6B, 6C, and 6D, respectively. FIG. 6A illustrates a 25% burst level where a first AC current 602 is applied to the heating element 202 for 25% of a heating cycle 604. Thus, the heating element 202 outputs an average of 25% of its upper (e.g., maximum) power output. FIG. 6B illustrates a second AC current 606 having a 50% burst level over the heating cycle 604 and FIG. 6C illustrates a third AC current 608 having a 75% burst level over the heating cycle 604. FIG. 6D illustrates a fourth AC current 610 having a 100% burst level (e.g., full on) over the heating cycle 604. The length of the example heating cycle 604 is selected such that the application and removal of AC current to the heating element 202 occurs less often than an upper flicker limit (e.g., in accordance with the IEC 61000-3-3 flicker requirement).

The example controller 206 alters the burst mode level of the heating element 202 when the controller 206 determines, via the temperature sensor 214, that a single burst mode level does not provide the desired temperature in the ink drying area 112. For example, the controller 206 may apply a 25% burst level to the heating element 202 for two cycles and then apply a 50% burst level to the heating element 202 for one cycle to achieve a net power level of 33% of the upper power dissipation of the heating element 202.

The controller 206 controls the second heating element 204 in an on/off mode. In contrast to the burst mode used to control the first heating element 202, the on/off mode either applies AC power to the heating element 204 for the entire heating period or cycle 604 (i.e., the on mode) or removes AC power from the heating element 204 for the entire heating period or cycle 604 (i.e., the off mode). While the controller 206 may switch the heating element 204 between the on mode and the off mode (e.g., to change the temperature of the ink drying area 112), in some examples the heating element 204 remains in either the on mode or the off mode when the temperature of the ink drying area 112 is to remain substantially constant.

Figure 7:
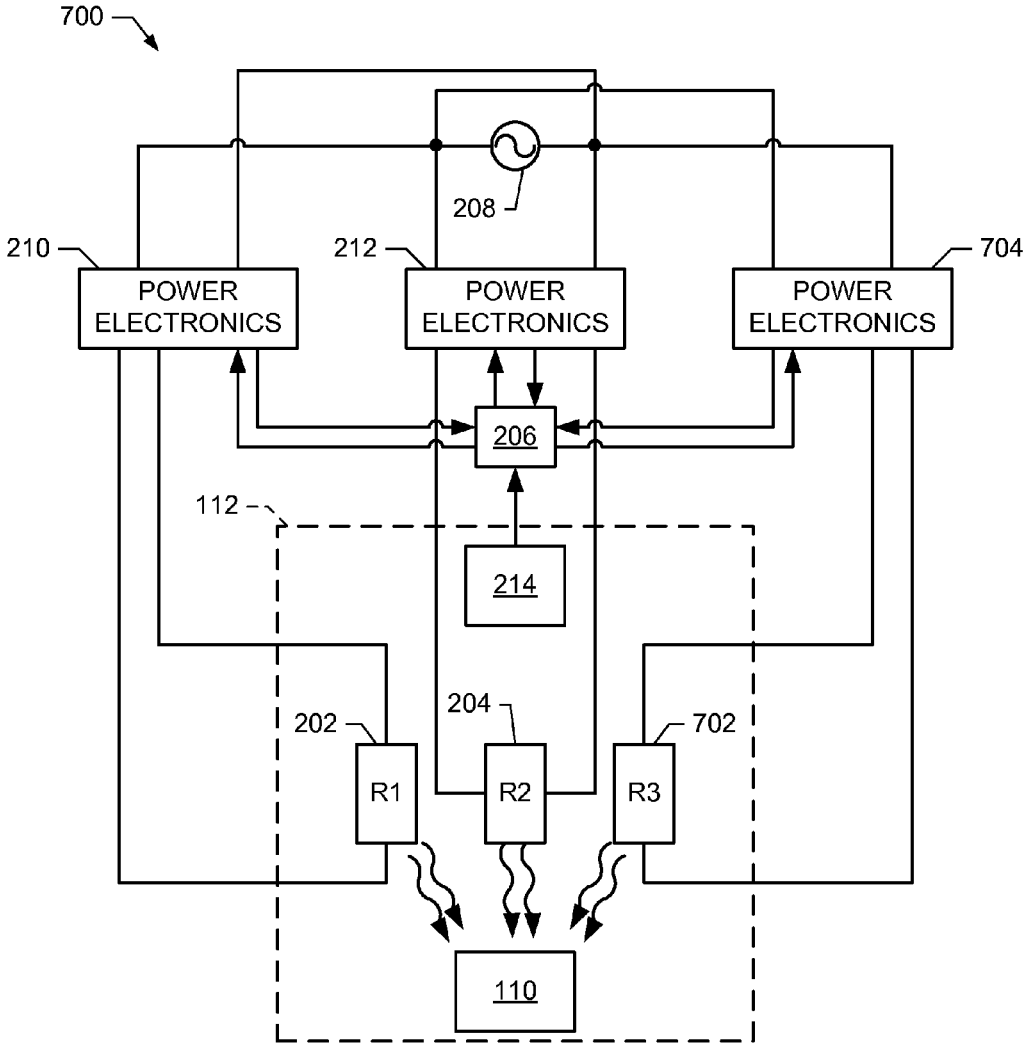
FIG. 7 is a schematic diagram of another example ink drying apparatus constructed in accordance with the teachings of this disclosure.

FIG. 7 illustrates another example ink drying apparatus 700 to implement the example ink drying apparatus 102 of FIG. 1. The example ink drying apparatus 700 of FIG. 7 includes heating elements 202 and 204, a controller 206, an AC current source 208, power electronics 210 and 212, and a temperature sensor 214 similar to the example ink drying apparatus 102 illustrated in FIG. 3. The apparatus 700 is in circuit with an AC power source 208. The example ink drying apparatus 700 also includes a third heating element 702 and corresponding power electronics 704. The example heating elements 202, 204, and 702 of FIG. 7 each have a substantially identical upper power output limit. Thus, the upper limit on the power level is 300% of the upper power level of one of the heating elements 202, 204, or 702.

Table 2 illustrates example power levels that may be applied to the heating elements 202, 204, and 702 of FIG. 7. In particular, the controller 206 controls the example heating elements 204 and 702 in an on/off mode and controls the heating element 202 in burst mode. As a result, the controller 206 may achieve different output power levels and, thus, different temperatures in the ink drying area 112 by setting the heating elements 204 and 702 to a combination of on and/or off modes and setting and/or adjusting the burst level of the heating element 202.

TABLE 2

| Control Level | | | Power Level | | | |
|---|---|---|---|---|---|---|
| R1 (Burst) | R2 (On/Off) | R3 (On/Off) | R1 | R2 | R3 | Total |
| 25% | Off | Off | 25% | 0% | 0% | 25% |
| 50% | Off | Off | 50% | 0% | 0% | 50% |
| 75% | Off | Off | 75% | 0% | 0% | 75% |
| 100% | Off | Off | 100% | 0% | 0% | 100% |
| 25% | On | Off | 25% | 100% | 0% | 125% |
| 50% | On | Off | 50% | 100% | 0% | 150% |
| 75% | On | Off | 75% | 100% | 0% | 175% |
| 100% | On | Off | 100% | 100% | 0% | 200% |
| 25% | On | On | 25% | 100% | 100% | 225% |
| 50% | On | On | 50% | 100% | 100% | 250% |
| 75% | On | On | 75% | 100% | 100% | 275% |
| 100% | On | On | 100% | 100% | 100% | 300% |

An example flicker requirement is the IEC 61000-3-3:2008 standard, edition 2.0, which is based on what can cause irritation to people experiencing fluctuations in power supply due to the flicker (e.g., due to variations in light output from a light bulb). For example, at 0.1 changes per minute (e.g., 0.00167 Hz, 1 change per 10 minutes), the IEC 61000-3-3: 2008 standard allows a relatively high change in voltage because people are less likely to notice minor power supply changes at that frequency. However, as the frequency increases to 1000 changes per minute (e.g., 16.67 Hz), people are generally more sensitive to power supply changes and therefore the IEC 61000-3-3:2008 standard permits a smaller change in voltage. As the frequency increases above 1000 changes per minute, a person's perception diminishes and the IEC 61000-3-3:2008 standard thus allows more of a voltage change. A copy of the IEC 61000-3-3:2008 standard is available from the International Electrotechnical Commission.

Assuming an equal power output between two heating elements and three heating elements, including three heating elements allows a greater distribution of power between the heating elements and, thus, causes less of a voltage change at the AC current distribution system when switched on and/or off. However, additional cost is generally required for each additional heating element that is included in the ink drying apparatus 102.

The example heating apparatus described herein also have improved EMI performance. In particular, the example ink drying apparatus 102 of FIG. 2 reduces electromagnetic interference by using burst mode and on/off modes to control the heating elements 202 and 204. The burst mode and the on/off mode do not generate either conducted emissions (e.g., 150 kHz-30 MHz) or radiated emissions (e.g., 30 MHz-2 GHz), because the burst mode and the on/off mode operate at frequencies less than 150 kHz and the burst mode is controlled in full and/or half AC cycles.

While the example methods and apparatus described herein refer to heating elements in a printer, the example methods and apparatus may be modified and/or adapted for other ink drying application(s). For example, other ink drying devices having high power consumption may be controlled using a combination of burst mode(s) and on/off mode(s) to comply with, for example, a flicker requirement, a requirement to avoid inducing harmonics in a power supply, and/or an EMI requirement.

Although certain methods, apparatus, and articles of manufacture have been described herein, the scope of coverage of this patent is not limited thereto. To the contrary, this patent covers all methods, apparatus, and articles of manufacture falling within the scope of the appended claims.

What is claimed is:

1. An ink drying apparatus, comprising:

first and second heating elements positioned adjacent a heating area in a printer; and a controller, responsive to a temperature of the heating area, to:

selectively operate the first heating element in a burst mode; and selectively operate the second heating element in an on/off mode concurrently with selectively operating the first heating element in the burst mode.

2. An ink drying apparatus as defined in claim 1, further comprising a switching element, the controller to operate the first heating element in the burst mode by controlling the switching element to conduct current through the first heating element for a number of alternating current cycles corresponding to a portion of a heating period.

3. An ink drying apparatus as defined in claim 2, wherein the number of alternating current cycles comprises a whole number of alternating current cycles.

4. An ink drying apparatus as defined in claim 1, further comprising a switching element, the controller to operate the second heating element in the on/off mode by controlling the switching element to maintain the second heating element in an on state or an off state for an entire heating period to maintain the temperature of the heating area at a desired temperature.

5. An ink drying apparatus as defined in claim 1, wherein the controller comprises first and second control switches to control respective ones of the first and second heating elements.

6. A method for controlling an ink drying apparatus, comprising:

comparing a temperature of a heating area at a first time to a desired temperature;

selectively controlling a first heating element to enter or exit a burst mode to adjust the temperature of the heating area based on the comparison; and selectively controlling a second heating element to enter or exit an on mode based on the comparison.

7. A method as defined in claim 6, wherein selectively controlling the first heating element comprises turning on or turning off the first heating element for a whole number of alternating current cycles corresponding to a portion of a heating period.

8. A method as defined in claim 6, further comprising measuring the temperature of the heating area.

9. A method as defined in claim 6, wherein selectively controlling the second heating element comprises maintaining the second heating element in an on state or an off state for an entire heating period.

10. A method as defined in claim 6, further comprising selectively controlling a third heating element to enter or exit an on mode or a burst mode based on the comparison.

11. A power control apparatus to control ink drying elements, comprising:

first power electronics to selectively operate a first ink drying element in a burst mode for a portion of an entire heating period, a burst time and a first power dissipation of the burst mode being in compliance with a flicker requirement;

second power electronics to operate a second ink drying element to selectively couple the second power element in an on/off mode, the second power electronics to maintain the second power element in an on state or an off state for the entire heating period; and a control device in communication with the first and second power electronics to compare a current temperature to a desired temperature, and to control the burst time associated with the first power electronics and the on/off state associated with the second power electronics based on the comparison.

12. A power control apparatus as defined in claim 11, wherein the burst time comprises a whole number of alternating current cycles.

13. A power control apparatus as defined in claim 11, wherein the burst time comprises a portion of a period of alternating current cycles.

14. A power control apparatus as defined in claim 11, wherein the control device comprises a microprocessor.

15. A power control apparatus as defined in claim 11, wherein the flicker requirement comprises the International Electrotechnical Commission 61000-3-3:2008 Flicker standard.

* * * * *